US012702186B1

(12) United States Patent
Blood

(10) Patent No.: US 12,702,186 B1
(45) Date of Patent: Aug. 11, 2026

(54) FOOTWEAR WITH ENHANCED GRIPPING SYSTEM

(71) Applicant: Richard Blood, Marvin, NC (US)

(72) Inventor: Richard Blood, Marvin, NC (US)

( * ) Notice: Subject to any disclaimer, the term of this patent is extended or adjusted under 35 U.S.C. 154(b) by 0 days.

(21) Appl. No.: 18/937,146

(22) Filed: Nov. 5, 2024

(51) Int. Cl.
*A43B 3/00* (2022.01)
*A43B 5/00* (2022.01)
*A43B 5/02* (2006.01)
*A43B 23/02* (2006.01)

(52) U.S. Cl.
CPC ..... *A43B 3/0036* (2013.01); *A43B 5/00* (2013.01); *A43B 5/025* (2013.01); *A43B 23/0205* (2013.01)

(58) Field of Classification Search
CPC ..... A43B 3/0036; A43B 5/00; A43B 5/002; A43B 5/003; A43B 23/0205; A43B 23/0245; A43B 5/025; A43C 7/00; A43C 7/02
USPC ..... 36/114, 133
See application file for complete search history.

(56) References Cited

U.S. PATENT DOCUMENTS 5,771,610 A 6/1998 McDonald
6,000,111 A * 12/1999 Deskins ..... A43C 7/02 24/712.1
6,192,559 B1 * 2/2001 Munsell, Jr. ..... A43C 7/00 24/712.9
6,408,542 B1 * 6/2002 Shepherd ..... A43B 23/26 36/114
6,523,282 B1 * 2/2003 Johnston ..... A43B 5/02 36/133
6,910,288 B2 6/2005 Dua
7,562,471 B2 7/2009 Minami
7,637,032 B2 12/2009 Sokolowski
9,009,992 B2 * 4/2015 Baker ..... A43C 11/1493 36/133
9,038,288 B2 5/2015 Droege
9,237,779 B2 1/2016 Berend
D981,690 S 3/2023 Engel
2002/0002781 A1 * 1/2002 Bouvier ..... A43B 23/26 36/50.1
2002/0029496 A1 * 3/2002 Morle ..... A43B 5/18 36/99
2002/0046476 A1 * 4/2002 Snyder ..... A43B 23/26 36/136
2003/0167658 A1 * 9/2003 Davis ..... A43B 5/025 36/128

(Continued)

FOREIGN PATENT DOCUMENTS

WO WO 2014/126947 8/2014

*Primary Examiner* — Marie D Bays
(74) *Attorney, Agent, or Firm* — Kyle A. Fletcher, Esq.

(57) ABSTRACT

The footwear with enhanced gripping system may include an athletic shoe, a plurality of gripping members, a shoe lace, and a lace cover. The athletic shoe may be adapted to be worn by a user that requires the enhanced gripping that may be provided by the plurality of gripping members coupled to the exterior of the athletic shoe. The athletic shoe may be adapted to be retained on a user's foot by the shoe lace and the shoe lace may be covered by the lace cover. The athletic shoes may be adapted to be worn as a pair of shoes with a left shoe on a user's left foot and a right shoe on a user's right foot. As non-limiting examples, the athletic shoes may be wrestling shoes, climbing shoes, running shoes, or hiking shoes.

18 Claims, 10 Drawing Sheets

(56) References Cited

U.S. PATENT DOCUMENTS

2004/0045196 A1* 3/2004 Shepherd ..... A43B 5/025 36/114
2006/0117600 A1* 6/2006 Greene ..... A43B 13/141 36/9 R
2007/0256328 A1* 11/2007 Arizumi ..... A43B 7/08 12/146 C
2009/0100712 A1* 4/2009 Baker ..... A43B 23/26 36/114
2010/0077637 A1* 4/2010 Hatzilias ..... A43B 3/0042 36/133
2010/0107346 A1* 5/2010 Aveni ..... A43D 8/12 12/146 B
2012/0233888 A1* 9/2012 Baker ..... A43B 5/025 36/133
2014/0360048 A1* 12/2014 DeHaven ..... A43B 23/0295 36/83
2015/0201705 A1* 7/2015 Doremus ..... A43B 23/0245 2/69
2015/0366281 A1* 12/2015 Miller ..... B32B 5/022 428/137
2016/0037863 A1* 2/2016 Harley ..... A43B 3/0031 36/72 R
2016/0095389 A1* 4/2016 Minami ..... A43B 23/0245 36/45
2016/0143395 A1* 5/2016 Van Atta ..... A43B 23/028 36/48
2016/0242500 A1 8/2016 Langvin
2016/0353842 A1* 12/2016 Langvin ..... A43C 7/005
2017/0071290 A1* 3/2017 Follet ..... A43B 23/0245
2017/0348935 A1* 12/2017 Leimer ..... A43B 23/0245
2018/0263339 A1* 9/2018 Neumann ..... A43B 3/0036
2019/0159551 A1* 5/2019 Qin ..... A43B 23/0235
2020/0121019 A1* 4/2020 Bartys ..... A43B 1/028
2021/0204640 A1 7/2021 Oroszi
2021/0345725 A1* 11/2021 Arana ..... A43B 23/0245
2022/0022599 A1 1/2022 Laverty
2024/0324724 A1* 10/2024 Dedonato ..... A43B 23/0245
2025/0072548 A1* 3/2025 Johnson ..... A43B 23/028

* cited by examiner

FOOTWEAR WITH ENHANCED GRIPPING SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of footwear and grip enhancement, more specifically, footwear with an enhanced gripping system.

Summary of Invention

The footwear with enhanced gripping system may comprise an athletic shoe, a plurality of gripping members, a shoe lace, and a lace cover. The athletic shoe may be adapted to be worn by a user that requires the enhanced gripping that may be provided by the plurality of gripping members coupled to the exterior of the athletic shoe. The athletic shoe may be adapted to be retained on a user's foot by the shoe lace and the shoe lace may be covered by the lace cover. The athletic shoes may be adapted to be worn as a pair of shoes with a left shoe on a user's left foot and a right shoe on a user's right foot. As non-limiting examples, the athletic shoes may be wrestling shoes, climbing shoes, running shoes, or hiking shoes.

An object of the invention is to provide an athletic shoe that may be worn by a user.

Another object of the invention is to provide a plurality of gripping members on the exterior of the athletic shoe, said plurality of gripping members being operable to increase friction between the athletic shoe and an external surface.

A further object of the invention is to pivotably couple the individual gripping members to the athletic shoe.

Yet another object of the invention is to provide a lace retainer within the top of the tongue and a lace cover in order to hide the shoe lace.

These together with additional objects, features and advantages of the footwear with enhanced gripping system will be readily apparent to those of ordinary skill in the art upon reading the following detailed description of the presently preferred, but nonetheless illustrative, embodiments when taken in conjunction with the accompanying drawings.

In this respect, before explaining the current embodiments of the footwear with enhanced gripping system in detail, it is to be understood that the footwear with enhanced gripping system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the footwear with enhanced gripping system.

It is therefore important that the claims be regarded as including such equivalent construction insofar as they do not depart from the spirit and scope of the footwear with enhanced gripping system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
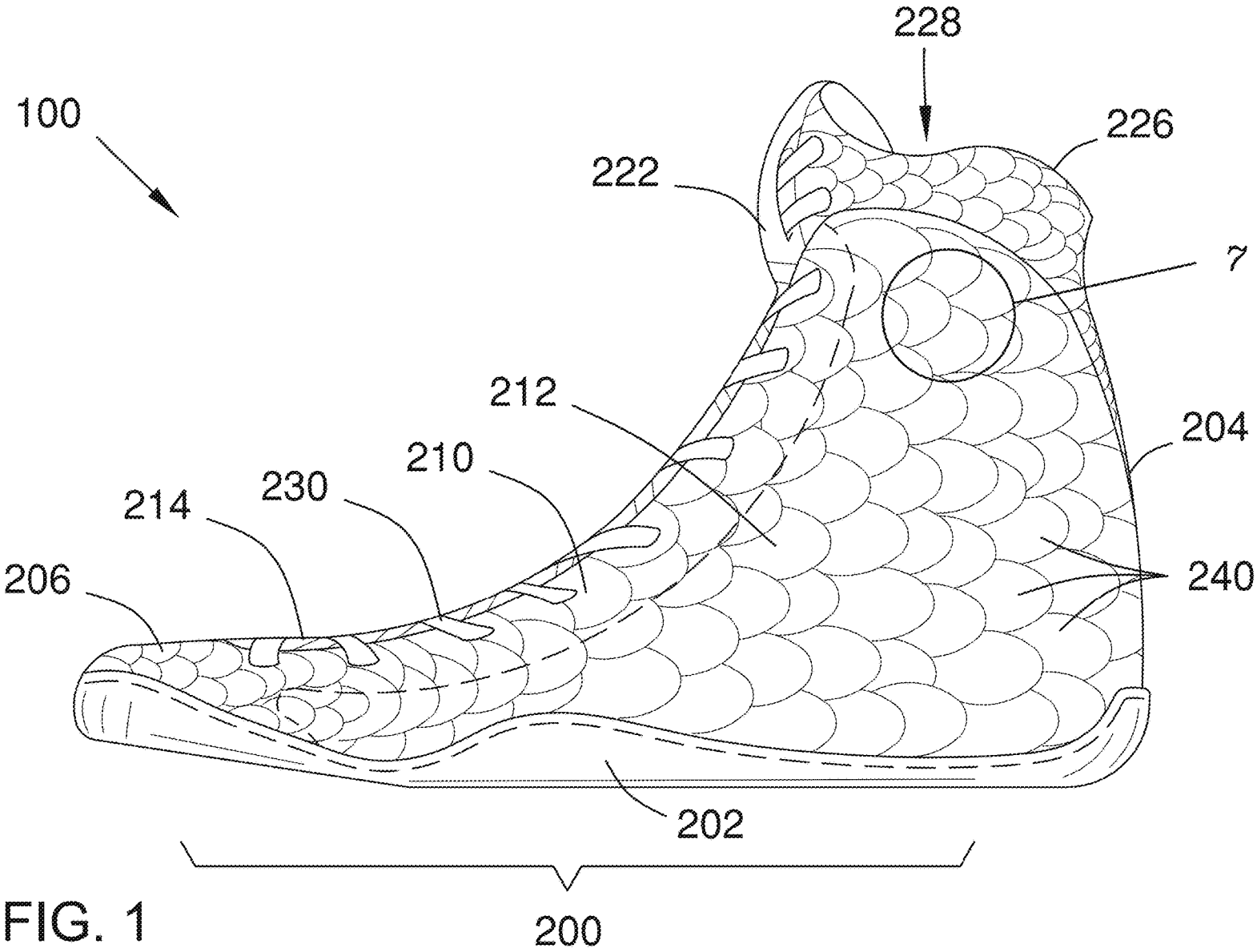
FIG. 1 is a left side view of an embodiment of the disclosure, illustrating elliptical gripping members.
Figure 3:
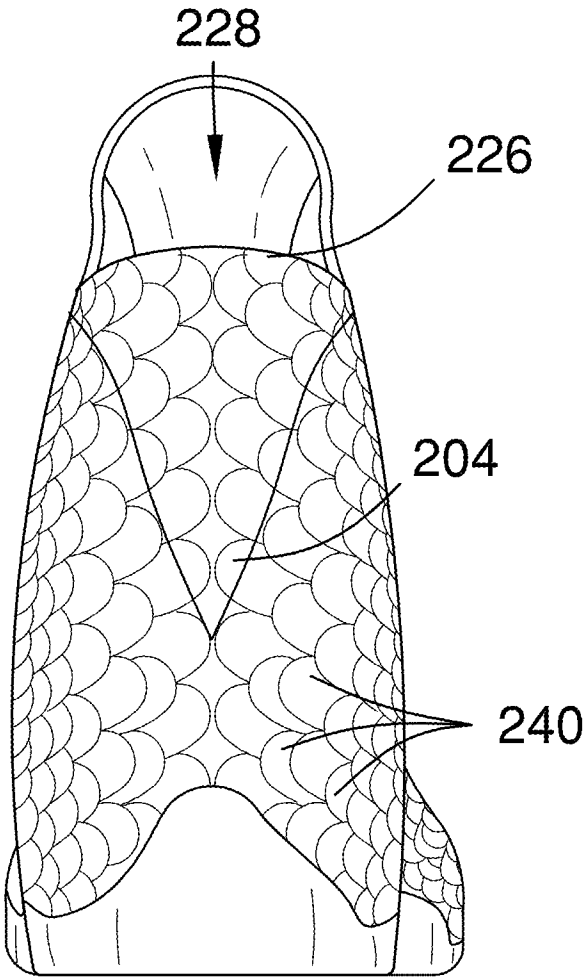
FIG. 3 is a rear view of an embodiment of the disclosure.
Figure 2:
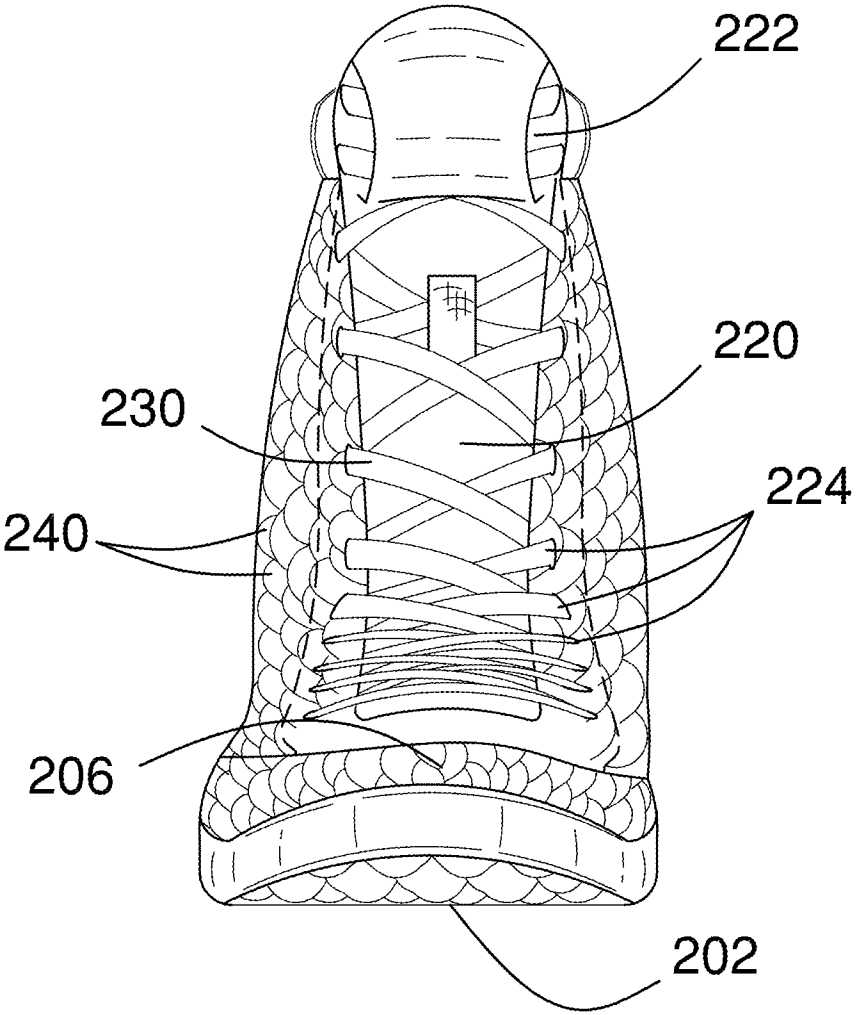
FIG. 2 is a front view of an embodiment of the disclosure.
Figure 4:
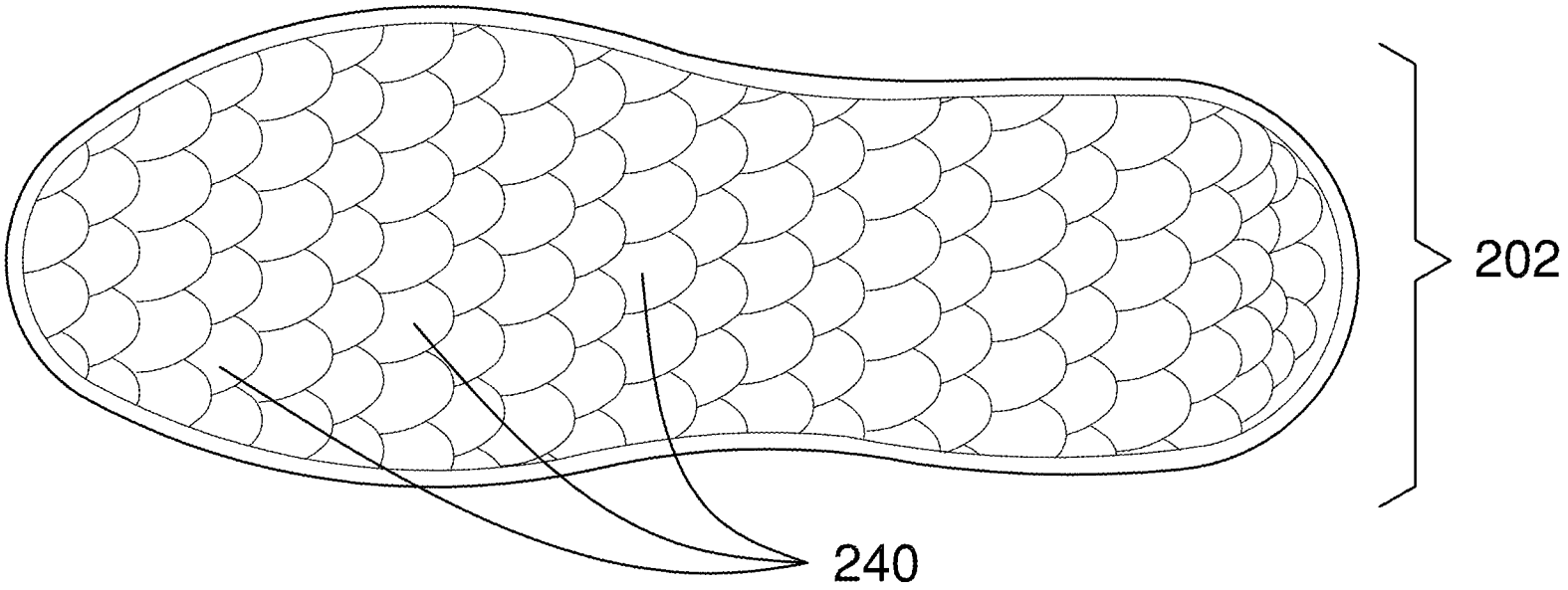
FIG. 4 is a bottom view of an embodiment of the disclosure.
Figure 5:
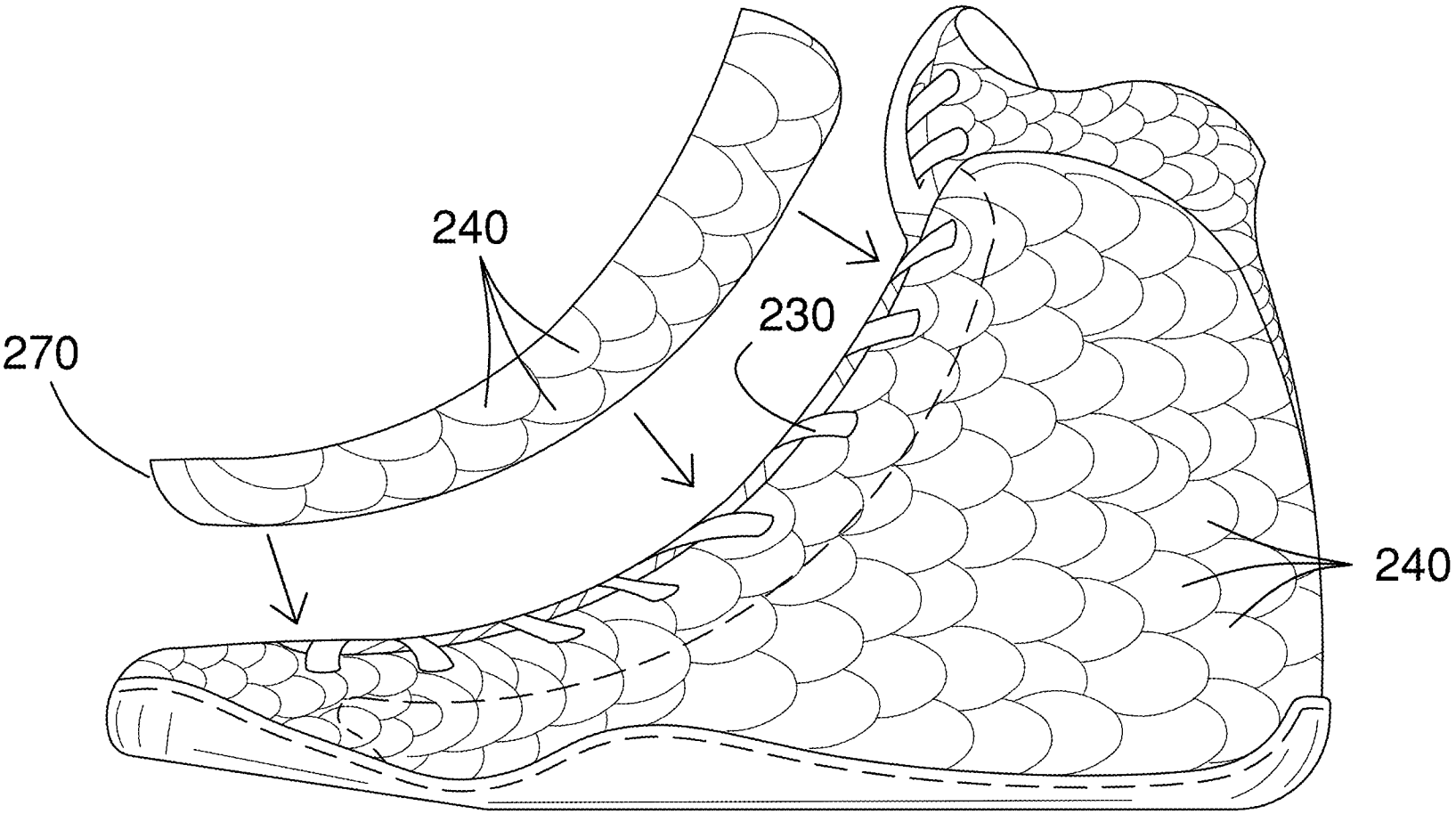
FIG. 5 is a left side view of an embodiment of the disclosure, illustrating placement of the lace cover.
Figure 6:
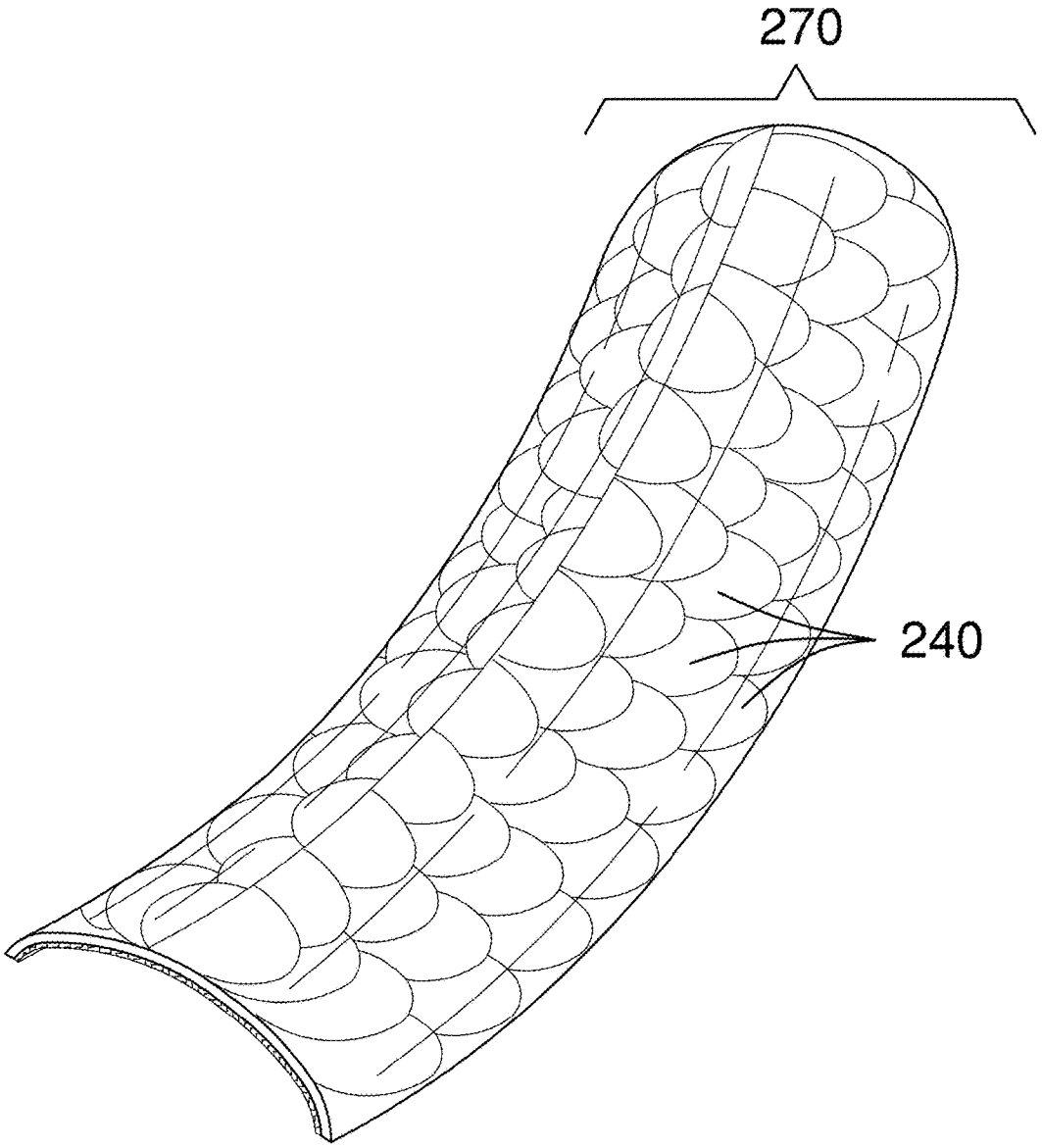
FIG. 6 is a detail side view of an embodiment of the disclosure, illustrating the lace cover.
Figure 7:
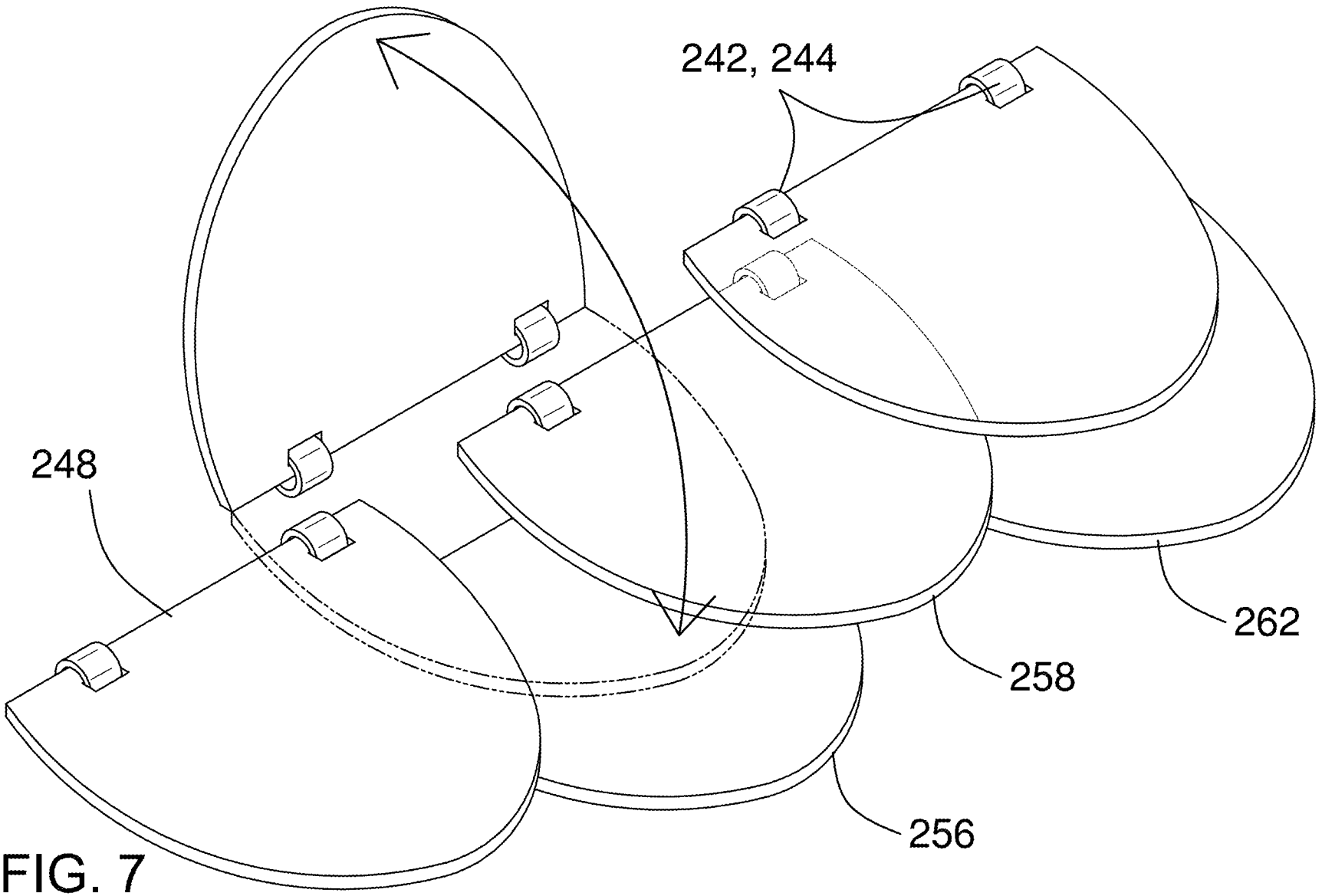
FIG. 7 is a detail view of an embodiment of the disclosure, illustrating hingedly coupled elliptical gripping members.
Figure 8:
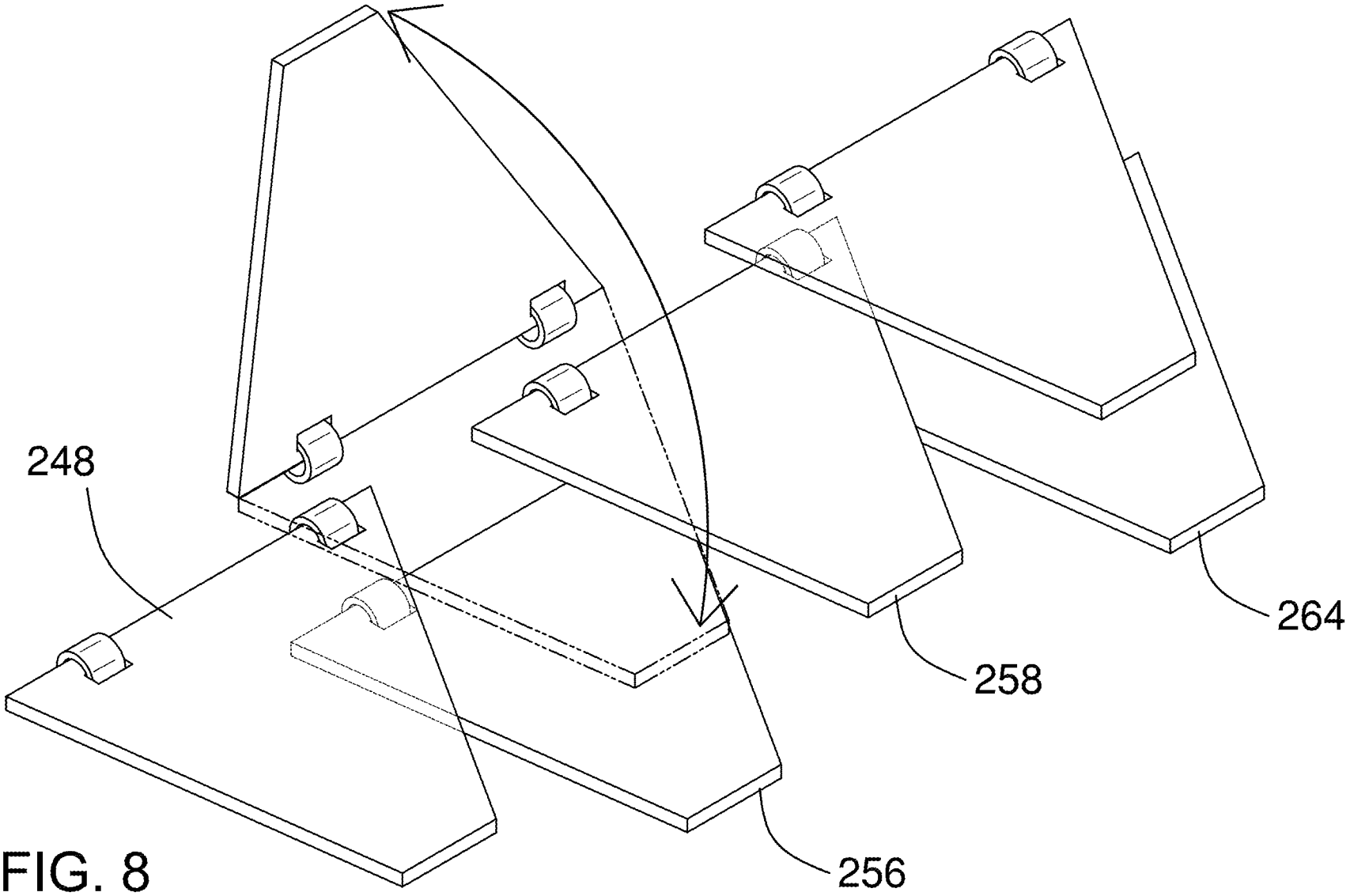
FIG. 8 is a detail view of an embodiment of the disclosure, illustrating hingedly coupled trapezoidal gripping members.
Figure 9:
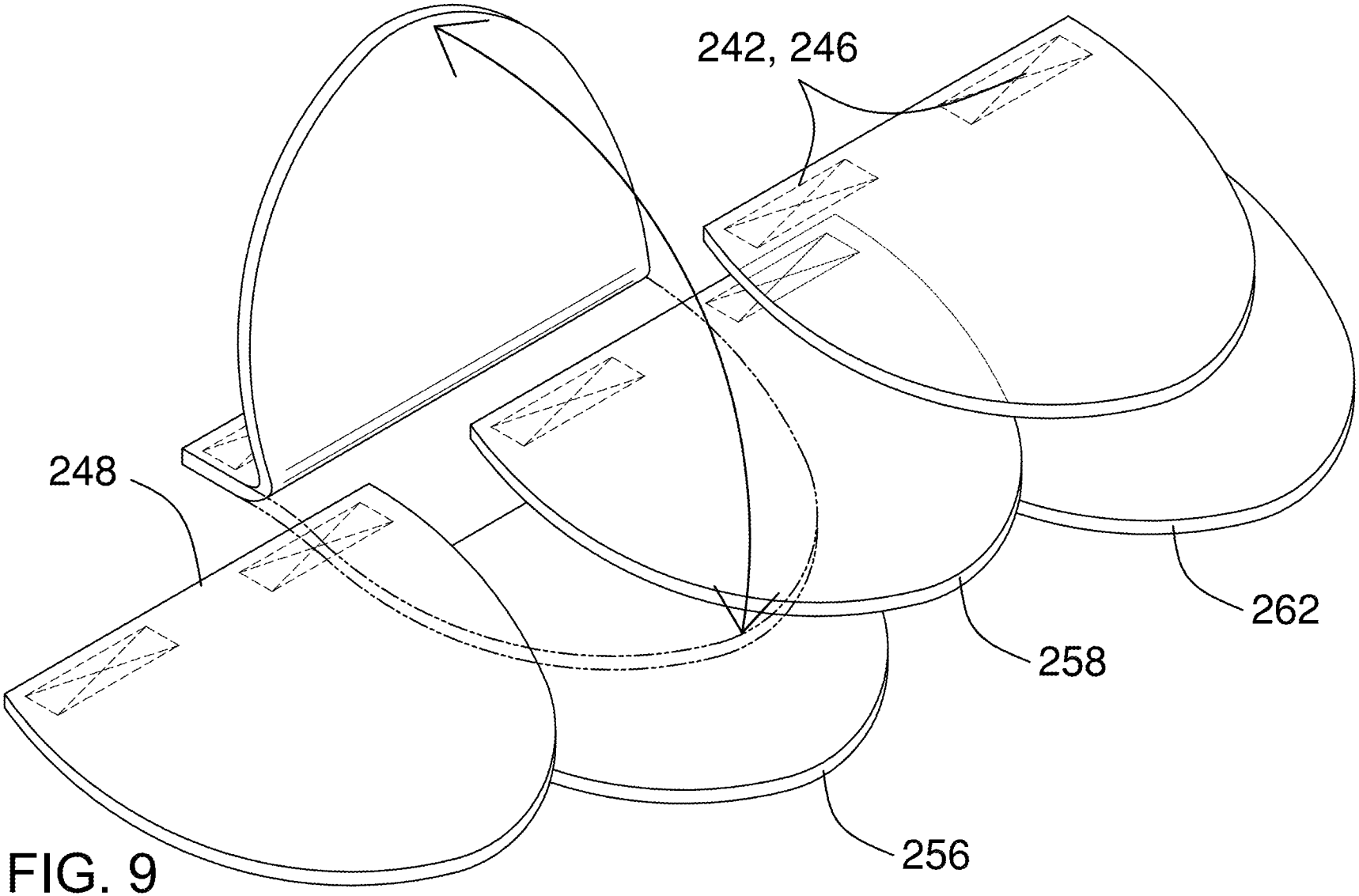
FIG. 9 is a detail view of an embodiment of the disclosure, illustrating stitch-coupled elliptical gripping members.
Figure 10:
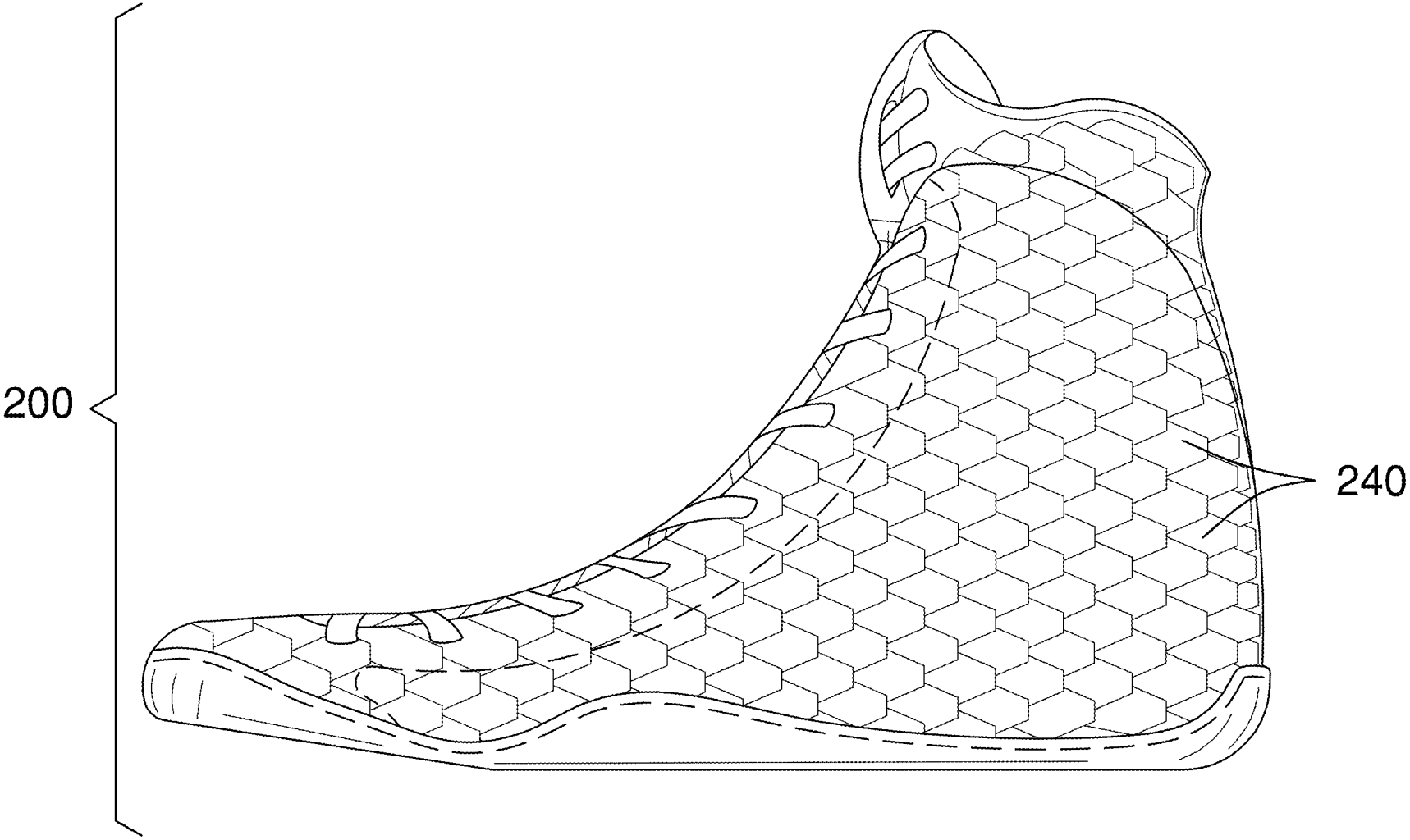
FIG. 10 is a left side view of an embodiment of the disclosure, illustrating trapezoidal gripping members.
Figure 11:
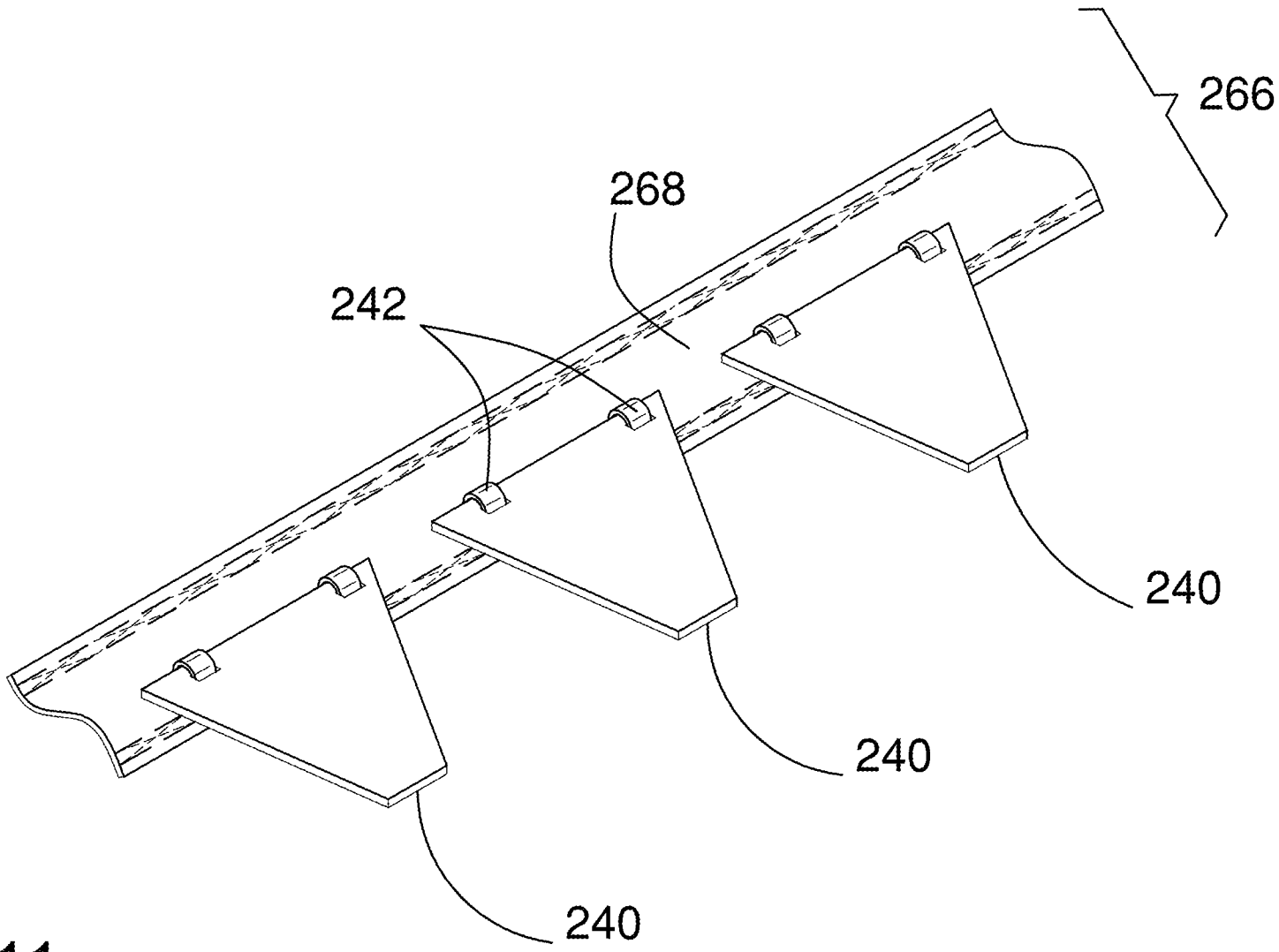
FIG. 11 is a detail view of an embodiment of the disclosure, illustrating gripping members and a backing strip comprising a gripping member assembly.

Detailed reference will now be made to a first potential embodiment of the disclosure, which is illustrated in FIGS. 1 through 11.

The footwear with enhanced gripping system 100 (hereinafter invention) comprises an athletic shoe 200, a plurality of gripping members 240, a shoe lace 230, and a lace cover 270. The athletic shoe 200 may be adapted to be worn by a user that requires enhanced gripping that may be provided by the plurality of gripping members 240 that may be coupled to the exterior of the athletic shoe 200. The athletic shoe 200 may be adapted to be retained on a user's foot by the shoe lace 230 and the shoe lace 230 may be covered by the lace cover 270. The athletic shoes 200 may be adapted to be worn as a pair of shoes with a left shoe on a user's left foot and a right shoe on a user's right foot. As non-limiting examples, the athletic shoes 200 may be wrestling shoes, climbing shoes, running shoes, or hiking shoes.

The athletic shoe 200 may comprise a sole 202, a heel counter 204, a toe cap 206, an upper 210, a tongue 220, a plurality of eyelets 224, a collar 226, or any combination thereof. The athletic shoe 200 may be adapted to be worn on the user's foot by placing the user's foot into the athletic shoe 200 through a throat 228 of the athletic shoe 200. The throat 228 may be an aperture located at the top of the athletic shoe 200.

The sole 202 may be the bottom of the athletic shoe 200. The sole 202 may comprise an outsole which may be the exterior bottom of the athletic shoe 200 and an insole which may be the interior bottom of the athletic shoe 200 that is adapted to contact the bottom of the user's foot.

The heel counter 204 may be the back of the athletic shoe 200. The toe cap 206 may be the front of the athletic shoe 200 and may be adapted to enclose a user's toes. The upper 210 may be the upper covering of the athletic shoe 200. The upper 210 may comprise a quarter 212 which may define the sides of the athletic shoe 200 and a vamp 214 which may cover the top front of the athletic shoe 200.

The tongue 220 may be a flexible flap that may partially cover the throat 228 and may be adapted to be moved to enlarge the throat 228 for insertion and removal of the user's foot. The top of the tongue 220 may comprise a lace retainer 222. The lace retainer 222 may be a hollow cavity passing laterally through the tongue 220 such that the ends of the shoe lace 230 may be placed into the lace retainer 222 to hide the ends of the shoe lace 230.

The athletic shoe 200 may comprise the plurality of eyelets which may be a plurality of apertures in the upper 210 positioned on both sides of the tongue 220. The shoe lace 230 may be strung through the plurality of eyelets 224 such that the shoe lace 230 may be adapted to tighten the athletic shoe 200 on the user's foot. The collar 226 may be the top edge of the quarter 212. In some embodiments, the collar 226 may be padded for comfort.

The plurality of gripping members 240 may be scales applied to the exterior of the athletic shoe 200 to enhance the gripping ability of the athletic shoe 200. An individual gripping member selected from the plurality of gripping members 240 may be pivotably coupled to the athletic shoe 200. The individual gripping members may overlap such that the base 248 of a first gripping member 256 may be covered by a second gripping member 258. The individual gripping member may be made from natural or synthetic rubber such that friction between the individual gripping member and an external surface may be increased as compared to the friction that would exist without the individual gripping member.

The plurality of gripping members 240 may be pivotably coupled to the exterior of the athletic shoe 200 such that the plurality of gripping members 240 may compensate for changes in the direction and strength of a force applied to the athletic shoe 200. In a preferred embodiment, each of the individual gripping members may be pivotably coupled to the athletic shoe 200 at two coupling points 242.

In some embodiments, the individual gripping member may be coupled to the athletic shoe 200 via a plurality of hinges 244. In some embodiments, the individual gripping member may be coupled to the athletic shoe 200 via a plurality of stitches 246.

The base 248 may comprise a straight edge to promote pivoting. The remaining edges of the individual gripping member may be shaped to define the appearance of the visible portion of the individual gripping member. As non-limiting examples, the individual gripping members may comprise a semi-circular shape, an elliptical shape 262, a trapezoidal shape 264, or any combination thereof.

The plurality of gripping members 240 may be coupled to the athletic shoe 200 individually, coupled to a gripping member assembly 266, or both. The gripping member assembly 266 may be made by coupling the individual gripping members to a backing strip 268. The gripping member assembly 266 may be coupled to the athletic shoe 200 such that the individual gripping members on adjacent gripping member assemblies overlap.

The lace cover 270 may be a panel that may cover the shoe lace 230 to assure maximum gripping of all parts of the athletic shoe 200. The exposed outer surface of the lace cover 270 may be covered by the plurality of gripping members 240. The lace cover 270 may couple to the athletic shoe 200 via a hook and loop fasteners.

The plurality of gripping members 240 may cover the outsole, the top surfaces of the athletic shoe 200 above the sole 202, the lace cover 270, or any combination thereof.

In use, the user may don athletic shoes 200 comprising a left shoe and the right shoe in preparation for an activity that may require enhanced gripping by the athletic shoes 200. As non-limiting examples, the athletic shoes 200 may be wrestling shoes, running shoes, climbing shoes, or hiking shoes. On each shoe, the shoe laces 230 may be tied, the tops of the shoe laces 230 may be secured within the lace retainers 222, and the lace covers 270 may be placed over the tongues 220 to further hide the shoe laces 230. The plurality of gripping members 240 covering the outside of the athletic shoes 200 may increase the friction between the athletic shoes 200 and external surfaces. The overlapping scales of the plurality of gripping members 240 may enhance the appearance of the athletic shoes 200.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "aperture" may be an opening in a surface or object. Aperture may be synonymous with hole, slit, crack, gap, slot, or opening.

As used herein, the words "couple", "couples", "coupled" or "coupling", may refer to connecting, either directly or indirectly, and does not necessarily imply a mechanical connection.

As used herein, "don" and "doff" may refer to the act of putting on and taking off (respectively) an item that may be worn by a user. Don is believed to have originated in the 14th century as a contraction of "do put on" and doff as a contraction of "do take off".

As used in this disclosure, the word "exterior" may be used as a relational term that implies that an object is not located or contained within the boundary of a structure or a space.

As used in this disclosure, "flexible" may refer to an object or material which will deform when a force is applied to it, which will not return to its original shape when the deforming force is removed, and which may not retain the deformed shape caused by the deforming force.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used in this disclosure, a "hook and loop fastener" may be a fastener that comprises a hook surface and a loop surface. The hook surface may comprise a plurality of minute hooks. The loop surface may comprise a surface of uncut pile that acts like a plurality of loops. When the hook surface is applied to the loop surface, the plurality of minute hooks may couple to the plurality of loops securely fastening the hook surface to the loop surface. The hook surface may sometime be referred to as a hard side fastener and the loop surface may sometimes be referred to as a soft side fastener.

As used in this disclosure, the "insole" may be the component of a shoe sole that is proximal to the wearer's foot.

As used in this disclosure, the word "interior" may be used as a relational term that implies that an object is located or contained within the boundary of a structure or a space.

As used in this disclosure, the word "lateral" may refer to the sides of an object or movement towards a side. Lateral directions are generally perpendicular to longitudinal directions. "Laterally" may refer to movement in a lateral direction.

As used in this disclosure, the "outsole" may be the outer component of the sole of the shoe that is in contact with the ground.

As used in this disclosure, the "quarter" may be the portion of the upper that is connected to the vamp and that surrounds the heel and the sides of the foot.

As used in this disclosure, the "vamp" may be the portion of the upper that covers the upper portion of the foot from the toes to where the vamp connects to the quarter.

With respect to the above description, it is to be realized that the optimum dimensional relationship for the various components of the invention described above and in FIGS. 1 through 11, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A footwear with enhanced gripping system comprising:
an athletic shoe, a plurality of gripping members, a shoe lace, and a lace cover;
wherein the athletic shoe is adapted to be worn by a user that requires enhanced gripping provided by the plurality of gripping members that are coupled to an exterior of the athletic shoe;
wherein the athletic shoe is adapted to be retained on a user's foot by the shoe lace and the shoe lace is covered by the lace cover;
wherein the athletic shoes are adapted to be worn as a pair of shoes with a left shoe on a user's left foot and a right shoe on a user's right foot;
wherein the plurality of gripping members are scales applied to the exterior of the athletic shoe to enhance the gripping ability of the athletic shoe;
wherein an individual gripping member selected from the plurality of gripping members is pivotably coupled to the athletic shoe;
wherein the individual gripping members overlap such that a base of a first gripping member is covered by a second gripping member.

2. The footwear with enhanced gripping system according to claim 1
wherein the athletic shoe comprises a sole, a heel counter, a toe cap, an upper, a tongue, a plurality of eyelets, a collar, or any combination thereof;
wherein the athletic shoe is adapted to be worn on the user's foot by placing the user's foot into the athletic shoe through a throat of the athletic shoe;
wherein the throat is an aperture located at the top of the athletic shoe.

3. The footwear with enhanced gripping system according to claim 2
wherein a sole is the bottom of the athletic shoe;
wherein the sole comprises an outsole which is the exterior bottom of the athletic shoe and an insole which is the interior bottom of the athletic shoe.

4. The footwear with enhanced gripping system according to claim 3 wherein a heel counter is the back of the athletic shoe;
wherein a toe cap is the front of the athletic shoe and is adapted to enclose a user's toes;
wherein the upper is the upper covering of the athletic shoe.

5. The footwear with enhanced gripping system according to claim 2
wherein the upper comprises a quarter which defines the sides of the athletic shoe and a vamp which covers the top front of the athletic shoe.

6. The footwear with enhanced gripping system according to claim 5
wherein the tongue is a flexible flap that partially covers the throat and is adapted to be moved to enlarge the throat for insertion and removal of the user's foot.

7. The footwear with enhanced gripping system according to claim 6
wherein the top of the tongue comprises a lace retainer;
wherein the lace retainer is a hollow cavity passing laterally through the tongue such that the ends of the shoe lace are placed into the lace retainer to hide the ends of the shoe lace.

8. The footwear with enhanced gripping system according to claim 7
wherein the athletic shoe comprises the plurality of eyelets which are a plurality of apertures in the upper positioned on both sides of the tongue;

wherein the shoe lace is strung through the plurality of eyelets such that the shoe lace is adapted to tighten the athletic shoe on the user's foot;

wherein the collar is the top edge of the quarter.

9. The footwear with enhanced gripping system according to claim 8 wherein the individual gripping member is made from natural or synthetic rubber such that friction between the individual gripping member and an external surface is increased.

10. The footwear with enhanced gripping system according to claim 8 wherein the plurality of gripping members are pivotably coupled to the exterior of the athletic shoe such that the plurality of gripping members compensate for changes in the direction and strength of a force applied to the athletic shoe.

11. The footwear with enhanced gripping system according to claim 10 wherein each of the individual gripping members are pivotably coupled to the athletic shoe at two coupling points.

12. The footwear with enhanced gripping system according to claim 11 wherein the individual gripping member is coupled to the athletic shoe via a plurality of hinges.

13. The footwear with enhanced gripping system according to claim 11 wherein the individual gripping member is coupled to the athletic shoe via a plurality of stitches.

14. The footwear with enhanced gripping system according to claim 10 wherein the base comprises a straight edge to promote pivoting;

wherein the remaining edges of the individual gripping member are shaped to define the appearance of the visible portion of the individual gripping member.

15. The footwear with enhanced gripping system according to claim 14 wherein the individual gripping members comprise a semi-circular shape, an elliptical shape, a trapezoidal shape, or any combination thereof.

16. The footwear with enhanced gripping system according to claim 15 wherein the plurality of gripping members are coupled to the athletic shoe individually, coupled to a gripping member assembly, or both;

wherein the gripping member assembly is made by coupling the individual gripping members to a backing strip;

wherein the gripping member assembly is coupled to the athletic shoe such that the individual gripping members on adjacent gripping member assemblies overlap.

17. The footwear with enhanced gripping system according to claim 16 wherein the lace cover is a panel that covers the shoe lace to assure maximum gripping of all parts of the athletic shoe;

wherein the exposed outer surface of the lace cover is covered by the plurality of gripping members;

wherein the lace cover couples to the athletic shoe via a hook and loop fasteners.

18. The footwear with enhanced gripping system according to claim 17 wherein the plurality of gripping members cover the outsole, the top surfaces of the athletic shoe above the sole, the lace cover, or any combination thereof.

* * * * *